US006423393B1

(12) United States Patent
Wildeman

(10) Patent No.: US 6,423,393 B1
(45) Date of Patent: Jul. 23, 2002

(54) ABRADED STITCHBONDED FABRIC AND PROCESS FOR MAKING SAME

(75) Inventor: Martin Wildeman, Spartanburg, SC (US)

(73) Assignee: Tietex International, Ltd., Spartanburg, SC (US)

( * ) Notice: Subject to any disclaimer, the term of this patent is extended or adjusted under 35 U.S.C. 154(b) by 63 days.

(21) Appl. No.: 09/641,361

(22) Filed: Aug. 18, 2000

Related U.S. Application Data

(60) Provisional application No. 60/150,103, filed on Aug. 20, 1999.

(51) Int. Cl.[7] ..... B32B 9/00

(52) U.S. Cl. ..... 428/91; 423/92; 423/93; 28/162

(58) Field of Search ..... 428/85, 91, 92, 428/93; 28/162

(56) References Cited

U.S. PATENT DOCUMENTS

| | | | |
|---|---|---|---|
| 3,649,427 | A | 3/1972 | Hughes |
| 3,769,815 | A | 11/1973 | Ploch et al. |
| 3,967,472 | A | 7/1976 | Wildeman |
| 3,992,904 | A | 11/1976 | Webb et al. |
| 4,320,167 | A | 3/1982 | Wishman |
| 4,606,964 | A | 8/1986 | Wideman |
| 4,657,802 | A | 4/1987 | Morman |
| 4,704,321 | A | 11/1987 | Zafiroglu |
| 4,737,394 | A | 4/1988 | Zafiroglu |
| 4,773,238 | A | 9/1988 | Zafiroglu |
| 4,841,749 | A | 6/1989 | Petracek et al. |
| 4,876,128 | A | 10/1989 | Zafiroglu |
| 4,998,421 | A | 3/1991 | Zafiroglu |
| 5,041,255 | A | 8/1991 | Zafiroglu |
| 5,075,142 | A | 12/1991 | Zafiroglu |
| 5,192,600 | A | 3/1993 | Pontrelli et al. |
| 5,514,457 | A | 5/1996 | Fels et al. |
| 5,879,779 | A | 3/1999 | Zafiroglu |
| 6,008,149 | A | 12/1999 | Copperwheat |
| 6,063,473 | A | 5/2000 | Zafiroglu |

FOREIGN PATENT DOCUMENTS

| | | |
|---|---|---|
| CA | 917890 | 1/1973 |

*Primary Examiner*—Elizabeth M. Cole
(74) *Attorney, Agent, or Firm*—Dority & Manning

(57) ABSTRACT

A suede-like stitchbonded fabric is disclosed. The stitchbonded fabric includes a nonwoven substrate. A first yarn is stitchbonded into the substrate in a manner that forms loops at the surface of the substrate. A second yarn is then also stitchbonded into the substrate in order to secure the loops to the fabric. Thereafter, the fabric is abraded for substantially breaking all of the loops at the surface of the fabric.

25 Claims, 1 Drawing Sheet

ABRADED STITCHBONDED FABRIC AND PROCESS FOR MAKING SAME

RELATED APPLICATIONS

The present application is based on a provisional application filed on Aug. 20, 1999 having Ser. No. 60/150,103.

FIELD OF THE INVENTION

The present invention generally pertains to abraded fabrics well suited for use in home furnishings such as for use in constructing upholstery. More particularly, the present invention is directed to an abraded stitchbonded fabric and to a process for making the fabric.

BACKGROUND OF THE INVENTION

Felt-like and suede-like fabrics have been used for years in the home furnishing and automotive industries. These fabrics have a pleasing look and tactile feel to their front side. Moreover, these fabrics can stand up to high friction environments while keeping their appearance intact. In the past, processes for creating these fabrics have included shearing, napping, or brushing warp-knitted or woven loop piled fabrics. These fabrics, however, have been relatively expensive to produce.

A cheaper alternative to warp-knitted or woven fabrics are stitchbonded fabrics. A stitchbonded fabric generally refers to a fabric made from a nonwoven web in which the fibers of the web are connected by stitches sewn or knitted through the web. In general, stitchbonded fabrics are relatively inexpensive to produce in comparison to many other woven fabrics. In the past, these types of fabrics have been used in many diverse and various applications.

The stitches in a stitchbonded fabric are typically applied to the webs in rows. In one embodiment, these stitches can be formed so as to make loops on the front side or face of the fabric. The loops create a loop pile on the face of the fabric.

Two limitations exist, however, to using stitchbonded fabrics as a replacement to the above-described felt-like or suede-like fabrics. The first limitation is the inability of conventional stitchbonded fabrics to withstand high wear such as when the fabric is used in upholstery applications. For instance, since the fabrics are made from a nonwoven substrate, they have a tendency to undergo pilling over time in high friction environments. Pilling refers to the formation of small balls or fuzz that develop on the fabric.

Further, conventionally made stitchbonded fabrics typically have an inherent degree of stretch created by the manner in which the fabrics are made. This stretch characteristic may be undesirable in certain high wear applications, such as when the fabric is used to cover furniture. For instance, in these applications, a stretchable fabric may not perform as well and may also adversely effect the appearance of the covered product.

The second limitation is finding a process which will convert stitchbonded fabrics into fabrics that have the appearance or feel of felt or suede. Traditionally, a shearing process has been used to produce suede-like fabrics from woven or knitted materials. However, when applied to stitchbonded fabrics, this shearing process is very slow, requiring many passes of the shearing apparatus over the stitchbonded fabric in order to insure that all the loops on the surface of the fabric are cut. The slowness of the shearing process renders it impractical and uneconomical for many end uses.

The traditional abrading processes of napping and brushing that are used on woven and warp-knitted loop piled fabrics, on the other hand, are too harsh for stitchbonded fabrics. The bristles of the nappers and/or the brushes tend to dig into the stitchbonded fabrics, causing the staple fibers of the nonwoven web to be pulled up through the outer stitching creating an undesirable appearance.

In view of the above deficiencies, a need currently exists for an economical abraded-loop piled stitchbonded fabric that may be used in high wear applications, such as for use as an upholstery fabric. A need also exists for the abraded stitchbonded fabric to have a pleasing aesthetic appearance and tactile feel that would make them desirable for use in the home furnishing and the automotive industries.

SUMMARY OF THE INVENTION

The present invention is generally directed to a suede-like fabric and to a process for producing the fabric. The fabric is a stitchbonded fabric including a planar substrate. The substrate can be, for instance, a nonwoven web containing staple fibers. The nonwoven web can have a basis weight of from about 80 gsm to about 200 gsm.

A first yarn is stitchbonded into the substrate forming rows of loop pile stitches. The loop pile stitches include loops that reside over the first surface of the substrate. For instance, the first yarn can be stitchbonded into the substrate in a manner that forms from about 14 to about 28 rows per inch in the cross machine direction and forms from about 18 to about 40 stitches per inch in the machine direction. The first yarn can be a texturized multifilament yarn made from polyester. The first yarn can have a denier of from about 50 to about 200.

A second yarn is stitchbonded into the substrate in order to secure the loop pile stitches to the substrate. The second yarn can be a multifilament polyester yarn that forms chain stitches into the substrate. The second yarn can have a denier from about 20 to about 150.

In accordance with the present invention, once the yarns have been stitchbonded into the substrate, the first surface of the fabric is abraded such that substantially all of the loops formed by the loop pile stitches are broken. The fabric can be abraded by being subjected to a sanding process.

In one embodiment of the present invention, the substrate can further contain binder fibers. The binder fibers can be, for instance, bicomponent fibers having a relatively low melting point sheath polymer. By incorporating binder fibers into the substrate and then subsequently heat treating the stitchbonded fabric, the binder fibers bond to adjacent fibers and give the fabric integrity.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
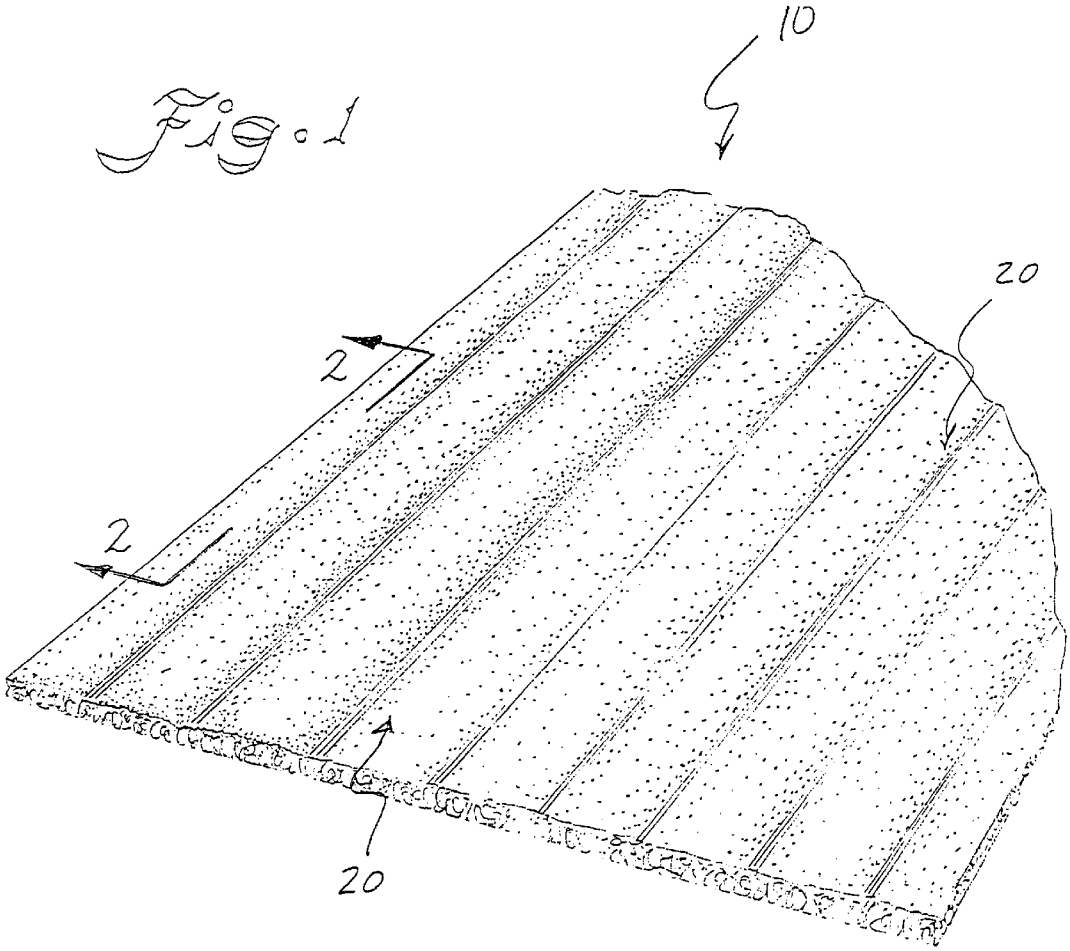
FIG. 1 is perspective view with cut away portions of an abraded stitchbonded fabric made in accordance with the present invention.

Repeat use of reference characters in the present specification and drawings is intended to represent same or analogous features of the invention.

DETAILED DESCRIPTION OF PREFERRED EMBODIMENTS

It is to be understood by one of ordinarily skill in the art that the present discussion is a description of exemplary embodiments only, and is not intended as limiting the broader aspects of the present invention, which broader aspects are embodied in the exemplary constructions.

The present invention is generally directed to an abraded stitchbonded fabric that has a pleasing aesthetic appearance and tactile feel and can be used in high wear and high friction applications. For example, the stitchbonded fabric of the present invention is particularly well suited for use as an upholstery fabric for covering furniture and automotive upholstery and the like. The fabric has a suede-like appearance and a soft hand. If desired, the fabric can be produced with little to no stretch characteristics, which preserves the appearance of the fabric when used to cover furniture. An additional benefit to those listed above is that fabrics made according to the present invention are relatively inexpensive to produce.

In general, the upholstery fabric of the present invention comprises a two bar stitchbonded fabric made from a substrate, particularly a nonwoven substrate. As is known in the art, a two bar fabric refers to a stitchbonded fabric made on a two bar stitchbonding machine in which 2 yarn sheets are fed to two independent guide bars. The guide bars feed the yarns to a bar of needles. In the stitchbonded fabric made according to the present invention, the first yarn is stitched into the front of the fabric. In particular, the first yarn is stitched into the fabric over a pile sinker so as to produce compacted loops on the face of the fabric. The second yarn, however, is stitchbonded primarily into the back of the fabric. In particular, the second yarn is tightly and densely inserted into the back of the fabric for giving the fabric integrity. Through this process, the first yarn loop stitched into the front of the fabric substantially covers the surface of the nonwoven substrate. The fabric is then run through a sanding process which abrades the top of the loops without penetrating into the nonwoven substrate giving the fabric a pleasant appearance and tactile feel.

The construction of fabrics made in accordance with the present invention will now be described in more detail.

The substrate used as the base of the stitchbonded fabric is preferably a nonwoven web structure, although a film, a woven, or a knitted product may be used. In particularly, the nonwoven substrate used to form the stitchbonded fabric is preferably a fiber fleece. For instance, the nonwoven substrate can be formed from staple fibers made from a synthetic material, such as polyester. While polyester is preferable, other synthetic fibers such as polypropylene or nylon as well as natural fibers such as wool may be used as staple fibers. A blend of different fibers may also be used. The staple fibers can have a denier of from about 2 to about 15 and a staple length of from 2 to 4 inches. In one embodiment, the staple fibers have a denier of about 4 and a staple length of about 4 inches. For most applications, the staple fibers should be heat treated or otherwise heat stable. This treatment causes the staple fibers to be heat set and keeps shrinkage of the web due to heat to a minimum.

In one embodiment, binder fibers can be incorporated into the nonwoven substrate in combination with the staple fibers. As used herein, binder fibers refer to fibers that when subjected to heat will bond with one another and with other materials contained within the web. Binder fibers are typically made from synthetic materials having a relatively low softening temperature such as low melting point polyesters. Although the binder fibers can be made entirely from a low melting point polymer, in one particular embodiment of the present invention, the binder fibers incorporated into the nonwoven substrate are multicomponent fibers, such as bicomponent fibers in which the low melting point polymer comprises the sheath polymer and a higher melting point fiber comprises the core polymer.

Although the fiber fleece can be formed according to various processes including an air laid process, preferably the fiber fleece comprises a carded and cross-lapped nonwoven web. In a preferred embodiment, the nonwoven web is also needlepunched to aid in stabilizing the nonwoven substrate construction. The basis weight of the nonwoven substrate can vary depending upon the particular application for which the fabric is to be used. For most applications, however, the nonwoven substrate can have a basis weight of from about 80 gsm to about 200 gsm or higher. In one embodiment, the basis weight of the substrate is about 100 gsm.

Once the nonwoven substrate is constructed, the substrate is fed into a double bar stitchbonding process wherein a first yarn is stitchbonded into the front side or face of the substrate, while a second yarn is stitchbonded into the back side of the substrate.

The first yarn is preferably a texturized yarn that is stitchbonded into the nonwoven substrate using a tricot stitch over a sinker to create the loop pile stitch. The first yarn should also be stitchbonded into the nonwoven web using a fine gauge row of needles. In particular, the yarn should be stitchbonded into the fabric using between 14 to 28 needles per inch, and preferably using 28 needles per inch. For most applications, the stitches per inch for the first yarn will range from 18 to 40, preferably between 20 to 36. In one particular embodiment, the stitching density of the front yarn is 28 stitches per inch.

The yarn stitchbonded into the front of the web, for instance, can be a multifilament yarn having a denier of from about 50 to about 200. In one embodiment, a 70 denier multifilament yarn made from polyester can be used. The multifilament yarn can be made from about 72 filaments.

In an alternative embodiment, the yarn stitchbonded into the front of the web can be a 150 denier multifilament yarn made from polyester. The multifilament yarn can be made from about 96 filaments. Although polyester multifilament yarns are desirable, other filament yarns, both texturized and untexturized, and even some spun yarns may be used.

By creating a high density of stitchings and stitchbonded rows, the yarn forms a uniform density of stitchbonded loops in the front of the substrate. The density of stitchings and stitchbonded rows make it easier for loop ridges to be abraded when the fabric is subsequently run through a sanding process. The density also aids in covering the nonwoven substrate. In this manner, the stitchbonded yarn protects the staple fibers of the nonwoven web and prevents the nonwoven substrate from being exposed to wear.

Preferably, the first yarn is also texturized so that the yarn will better cover the nonwoven substrate. As is known in the art, a textured yarn refers to a yarn containing crimp. For instance, in one process for texturizing yarn, the yarn is fed through frictional discs which twist the yarn and creates the crimp in the yarn. Once heated, the crimp becomes heat set into place.

Different patterns may be stitchbonded into the face of the fabric in the form of straight or zigzagged lines (using for instance an Atlas stitch construction) by manipulating these first yarns. The various patterns are formed by removing designated first yarns from the front bar and allowing particular needles contained in the stitchbonding machine to operate without the yarns at selected times. These types of patterns are known by those skilled in the stitchbonding art.

As opposed to the first yarns stitchbonded into the front of the fabric, the second yarns stitchbonded into the back of the fabric are preferably flat, dull yarns meaning the yarns are not texturized and refract little light. Although flat, dull yarns are desirable, however, it should be understood that any suitable yarn may be used without limitation. For instance, texturized and spun yarns may be used as second yarns. The yarn can be a draw warped yarn, which refers to a relatively straight yarn that has been stretched.

The second yarn is more tightly stitchbonded into the web in relation to the first yarn at the same gauge (needles per inch) as described above. Preferably, a chain stitch, such as a 0.1/0.1, is used which secures the pile yarns and gives stability in the warp direction (machine direction). Once incorporated into the web, the second yarn is not visible from the front side of the fabric but provides the web with integrity and strength.

In one embodiment, the yarn stitchbonded into the back of the web is a multifilament polyester yarn having a denier of from about 20 to about 150. In one preferred embodiment, the multifilament yarn can have a denier of about 70 and can be made from about 34 filaments. For most applications the second yarn should be polyester, although other synthetic or natural fibers may be used.

In one embodiment of the present invention, once the nonwoven substrate has been stitchbonded in the front and back, the fabric may be heat treated. More particularly, the fabric can be transported through a tenter frame at about 350° F. for about 30 seconds. In this manner, the fabric is firmed up and the fibers stabilized. Also, the texturized yarns may bulk, making the yarns look fuller. Further, during heat treatment, any binder fibers that may be present in the web melt and bond. Once heat treated, the fabric can be dyed as desired as is known within the textile art or may be left as a greige good.

Next, in accordance with the present invention, the front of the stitchbonded fabric is abraded to create the desirable suede-like appearance on the face of the fabric. In one embodiment, a sanding process is used against the face of the fabric until substantially all the loops are broken. In general, any suitable sanding process known to the textile art may be used.

In a preferred embodiment, a contact sander with lint suction is used in which sanding rolls, covered with gritty surfaces such as emery paper, rotate and contact the face of the fabric as the fabric is being pull across the rolls. The gritty surface abrades the ridges formed by the top of the loops on the face of the fabric as the fabric travels across the rotating sanding rolls. The abrasion of the loops by the sanding rolls creates a cut pile of nonuniform height on the face of the fabric.

In one embodiment, the sander has five consecutive cylindrical sanding rolls aligned parallel to each other along a central axis. Between the sanding rolls, guide bars are disposed above the central axis. The fabric is transported between the guide bars and the sanding rolls with the front of the fabric facing the rolls. As the fabric is being transported across the sanding rolls, the rolls will rotate in either the direction in which the fabric is traveling or in the opposing direction. The set of sanding rolls may all rotate in the same direction, or the rolls may rotate in different directions within the set. In a preferred embodiment, the first, third, fourth, and fifth sanding rolls may rotate in the opposite direction to the direction that the fabric is traveling, while the second sanding roll travels in the same direction as the fabric is traveling.

Within the contact sander, the surfaces of the sanding rolls may be of different coarseness ranging from 60 to 280 grit or about 240 microns to 50 microns. In a preferred embodiment, the coarseness of each roll within the sander will increase along the machine direction (the direction in which the fabric travels). For instance, it is important generally for the first and second sanding rolls not to be too coarse. A finer grit prevents the rolls from grabbing or tearing the fabric. Too aggressive grit in the beginning will cause an undesirable effect on the fabric. For instance, the first and second sanding rolls should generally be a fine grit around 280, or 50 microns. The third and fourth sanding rolls in the same embodiment would have a normal grit of about 180, or 80 microns. These rolls more aggressively abrade a larger number of the loops on the front of the fabric than the first two rolls. The fifth and final sanding roll has a coarse grit of around 80, or 180 microns. This grit is very aggressive and insures that substantially all the loops are broken on the front of the fabric.

The speed of the sanding process should be set so that the sander will not penetrate the nonwoven substrate in relation to the coarseness of the surfaces of the sanding rolls. In this manner, any pattern that is stitched into the fabric is left intact. Preferably, the fabric is transported through the sander at approximately 15 yards per minute, although it may be operated at both higher and lower speeds.

After the fabric has been processed through the sander, it has a pleasing suede-like appearance. The nonuniform pile height of the abraded fabric aids in its appearance. Once completely constructed, the fabric has many uses and applications. For instance, the fabric is well suited to covering furniture, automotive upholstery and other similar objects.

Figure 2:
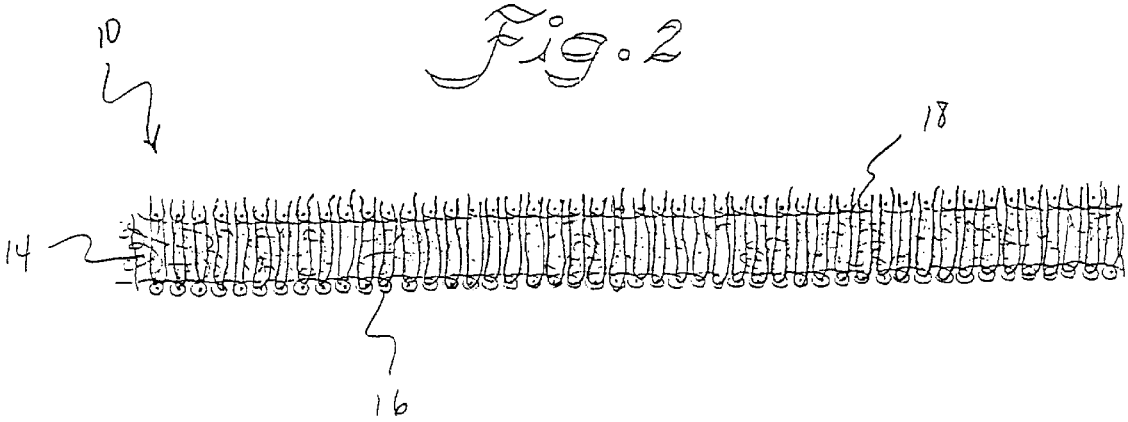
FIG. 2 is a cross-sectional view of the fabric illustrated in FIG. 1.

Referring now to FIGS. 1 and 2, one embodiment of a fabric generally 10 made in accordance with the present invention is illustrated. As shown particularly in FIG. 2, fabric 10 includes a nonwoven web 14 which has been stitchbonded in accordance with the present invention. In particular, fabric 10 includes loop pile sinker stitches 18 which pass through the entire web and stitches 16 which are densely stitch bonded into the back of the fabric for providing the fabric with integrity and strength.

In accordance with the present invention and as shown in the figures, stitchbonded loops 18 have been abraded using, for instance, a sanding process which creates a suede-like surface on the face of the fabric. Specifically, as shown in FIG. 2, a pile of yarns having a non-uniform height are formed on a surface of the fabric.

As described above, by manipulating the stitchbonding process, various patterns can be formed into the fabric. For example, as shown in FIG. 1, a pattern of parallel lines generally 20 can be constructed by removing designated yarns from the stitchbonding machine that form the loop pile stitches. In this manner, where the parallel lines appear in the fabric, no yarns emerge from the nonwoven web.

Besides parallel lines as shown in FIG. 1, many other types of patterns can also be formed into the fabric.

These and other modification and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed is:

1. A fabric comprising:

a planar substrate having a first surface and a second surface;

a first yarn stitchbonded into said substrate, said first yarn forming loop pile stitches such that loops reside over said first surface of said substrate;

a second yarn stitchbonded into said substrate, said second yarn forming chain stitches for securing said loop pile stitches to said substrate; and wherein said first surface has been abraded such that substantially all of the loops formed by said loop pile stitches are broken.

2. A fabric as defined in claim 1, wherein said substrate comprises a nonwoven web.

3. A fabric as defined in claim 2, wherein said nonwoven web includes staple fibers and binder fibers, said binder fibers being bonded to other fibers in said web.

4. A fabric as defined in claim 3, wherein said binder fibers comprise bicomponent fibers.

5. A fabric as defined in claim 2, wherein said substrate has a basis weight of from about 80 to about 200 gsm.

6. A fabric as defined in claim 1, wherein said first yarn comprises a texturized multifilament yarn.

7. A fabric as defined in claim 6, wherein said first yarn has a denier from about 50 to about 200.

8. A fabric as defined in claim 1, wherein said first yarn is stitchbonded into said substrate in a manner that forms from about 14 to about 28 rows per inch and wherein said first yarn is stitchbonded into said substrate at a stitch density of from about 18 to about 40 stitches per inch.

9. A fabric as defined in claim 1, wherein said second yarn has a denier of from about 20 to about 150.

10. A fabric as defined in claim 1, wherein said first surface is abraded by being sanded.

11. A fabric comprising:

a planar substrate having a first surface and a second surface, said substrate comprising a nonwoven web;

a first yarn loop pile stitched into said substrate in a manner that forms loops over said first surface of said substrate;

a second yarn stitched into said substrate for securing said loop pile stitches to said substrate; and wherein said first surface has been abraded such that substantially all of the loops formed by said loop pile stitches are broken.

12. A fabric as defined in claim 11, wherein said nonwoven web includes staple fibers and binder fibers, said binder fibers being bonded to other fibers in said web.

13. A fabric as defined in claim 11, wherein said first yarn is a texturized multifilament yarn having a denier of from about 50 to about 200.

14. A fabric as defined in claim 11, wherein said first yarn is stitchbonded into said substrate in a manner that forms from about 14 to about 28 rows per inch and wherein said first yarn is stitchbonded into said substrate at a stitch density of from about 18 to about 40 stitches per inch.

15. A fabric as defined in claim 11, wherein said second yarn forms chain stitches into said substrate.

16. A fabric as defined in claim 13, wherein said first yarn is made from polyester.

17. A fabric as defined in claim 11, wherein said loop pile stitches form a visible pattern on said first surface of said substrate.

18. A fabric as defined in claim 11, wherein said first surface is abraded by being sanded.

19. A process for forming a fabric comprising the steps of:

providing a nonwoven substrate having a first surface and a second surface;

stitchbonding a first yarn into said nonwoven substrate in a manner that forms loop pile stitches, said loop pile stitches forming loops on said first surface of said substrate;

stitchbonding a second yarn into said nonwoven substrate in a manner that forms chain stitches, said chain stitches securing said loop pile stitches into said substrate; and abrading said first surface of said substrate in a manner such that substantially all of said loops formed by said loop pile stitches are broken.

20. A process as defined in claim 19, wherein said nonwoven substrate comprises staple fibers and binder fibers and wherein the process further comprises a step of heat treating said fabric for causing said binder fibers to bond to adjacent fibers.

21. A process as defined in claim 19, wherein said first yarn is stitchbonded into said nonwoven substrate so as to form from about 14 to about 28 rows of stitches per inch and so as to have a stitch density of from about 18 to about 40 stitches per inch.

22. A process as defined in claim 19, wherein said first yarn comprises a texturized multifilament polyester yarn.

23. A process as defined in claim 19, wherein said first surface is abraded by being sanded.

24. A process as defined in claim 19, wherein said nonwoven web has a basis weight of from about 80 gsm to about 200 gsm.

25. A process as defined in claim 19, wherein said second yarn comprises a multifilament yarn having a denier of from about 20 to about 150.

* * * * *